United States Patent [19]

Carlmark

[11] Patent Number: 4,653,357

[45] Date of Patent: Mar. 31, 1987

[54] WRENCH

[76] Inventor: Rolf Carlmark, Box 756, S-892 00 Domsjö, Sweden

[21] Appl. No.: 750,424

[22] Filed: Jun. 28, 1985

[51] Int. Cl.[4] ..... B25B 13/14

[52] U.S. Cl. ..... 81/133; 81/129.5; 192/67 R; 192/99 S

[58] Field of Search ..... 81/133, DIG. 3, 134, 81/135, 139, 140, 142, 136, 145, 129.5, 129; 192/67 R, 99 S

[56] References Cited

U.S. PATENT DOCUMENTS

| | | | |
|---|---|---|---|
| 983,628 | 2/1911 | Lindsay | 81/DIG. 3 X |
| 1,148,410 | 7/1915 | Smith et al. | 81/DIG. 3 X |
| 1,386,596 | 8/1921 | Carpenter | 81/133 X |
| 2,069,582 | 2/1937 | Justice | 81/133 |
| 4,454,791 | 6/1984 | Seward | 81/133 |

FOREIGN PATENT DOCUMENTS

| | | | |
|---|---|---|---|
| 36309 | 7/1926 | Denmark | 81/133 |

*Primary Examiner*—Robert P. Olszewski
*Assistant Examiner*—Bradley I. Vaught
*Attorney, Agent, or Firm*—Merchant, Gould, Smith, Edell, Welter & Schmidt

[57] ABSTRACT

A wrench comprises a handle and a gripping mouth which is defined by two jaws, one of which is fixed and the other movable. The movable jaw is associated with a rack engaging a gear which is rotatably mounted relative to the handle and actuated by at least one spring constantly striving to rotate the gear in a direction such that the jaws are moved towards one another, said gear cooperating with a locking device which can be set in two different positions, a first position in which the gear is freely rotatable, and a second position in which the gear is non-rotatable and in which the gear, in turn, renders displacement of the movable jaw relative to the fixed jaw impossible.

2 Claims, 4 Drawing Figures

WRENCH

FIELD OF THE INVENTION

The present invention relates to a wrench comprising a handle and a gripping mouth defined by two jaws, one of which is fixed and the other movable to permit variation of the gripping mouth.

BACKGROUND OF THE INVENTION

In conventional wrenches of the above-mentioned type, the movable jaw is moved relative to the fixed jaw by means of a manually rotatable roller mounted on a shaft and having an external helical cam engaging sloping teeth on the movable jaw. Adjustment of such wrenches to different effective mouth widths is a time-consuming and tiresome procedure, especially if the effective size varies considerably and often.

The wrench according to U.S. Pat. No. 1,386,596 has a locking means which serves to lock the jaws in a desired position and which is in the form of a finger manually shiftable between two end positions and cooperating with a separate rack specially designed for this purpose. The gear, on the other hand, engages another rack on the handle. Designing, in this manner, the movable jaw with two racks is possible in the rather odd wrench construction disclosed in this patent specification, but in wrenches of more conventional design and of the type with which the present invention is concerned, this is inconceivable in actual practice. As has been stated below, the invention, however, relies on a solution where the gear in question engages, on the one hand, a rack on the movable jaw and, on the other hand, at the same time normally engages a splined coupling which serves as a locking means. In the present invention, this splined coupling is arranged such that, when no pressure is exerted on a push member, it holds the gear in locking position. This locking engagement can be released by actuation of said push member, more particularly when the wrench is applied to a nut or the like, whereupon the spring causes the splined coupling automatically to return to locking position as soon as the push member is released. In the construction according to U.S. Pat. No. 1,386,596, however, the finger must be moved back into engagement with the rack for locking. The provision of the rocker in the construction according to the present invention makes it possible to locate the push member at a point along the handle readily accessible to the operator's hand.

The wrench according to U.S. Pat. No. 4,454,791 comprises, it is true, a rotatable gear, but the locking device for this gear bears no resemblance whatsoever with the locking device which is used in the present invention. In the wrench according to U.S. Pat. No. 4,454,791, the gear thus is locked by means of a laterally movable locking member by which automatic return into locking position can never be accomplished, as is required in the present invention.

BRIEF DESCRIPTION OF THE INVENTIVE IDEA

The present invention aims at providing a wrench which is self-adjusting and thus rapidly applicable to different types of nuts and/or bolt heads, independently of the highly varying dimensions of such fastening means. These and other objects are achieved in that the movable jaw is associated with a rack engaging a gear which is rotatably mounted relative to the wrench handle and which is actuated by at least one spring constantly striving to rotate the gear in a direction such that the jaws are moved towards one another, said gear cooperating with a locking mechanism adjustable into two different positions, a first or opening position in which the gear is freely rotatable, and a second or locking position in which the gear is non-rotatable and in turn renders displacement of the movable jaw relative to the fixed jaw impossible.

DETAILED DESCRIPTION OF A PREFERRED EMBODIMENT OF THE INVENTION

Figure 1:
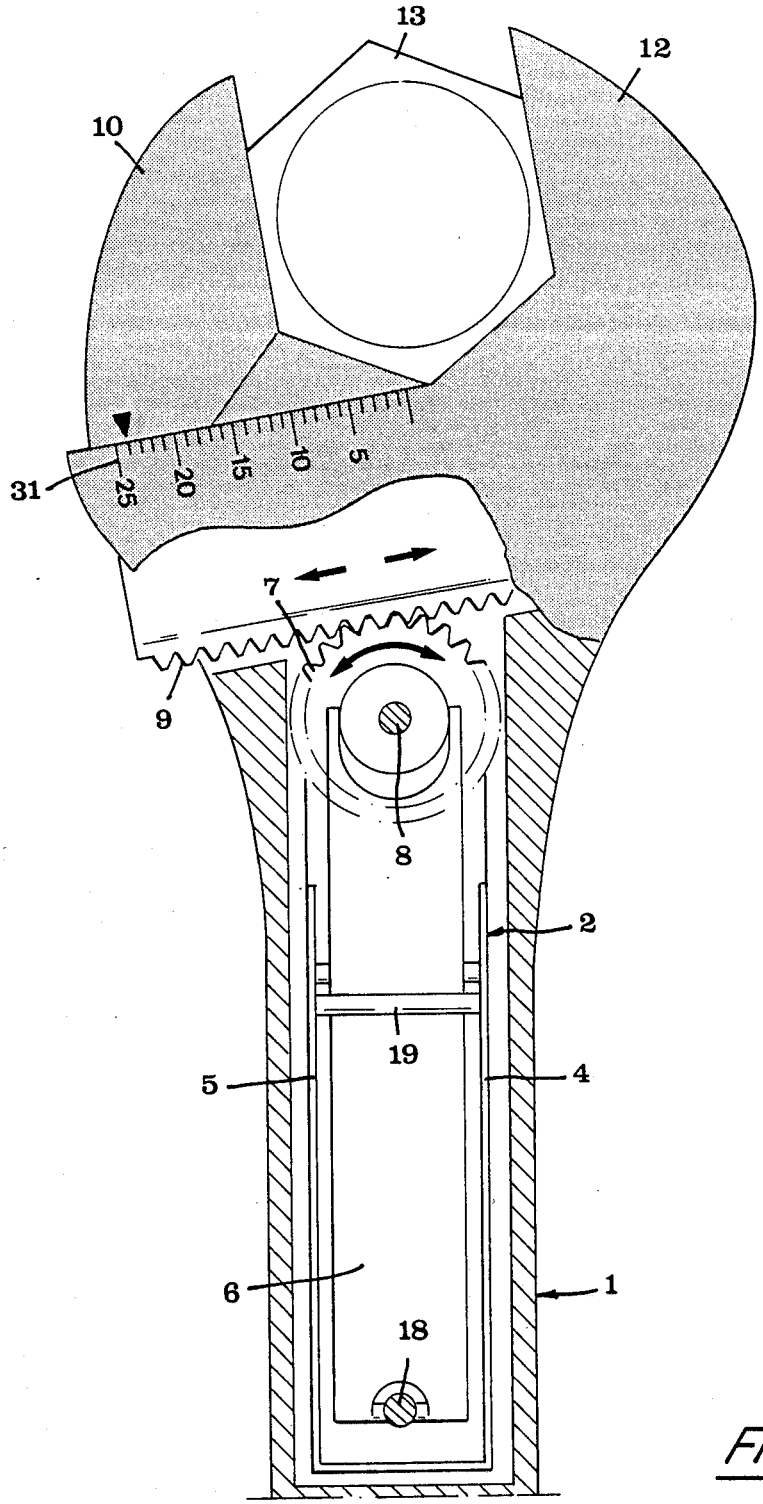
FIG. 1 is a plan view partly in section of a wrench according to the present invention.

In the drawings, 1 is the handle of a wrench which comprises two jaws defining a gripping mouth for, for example, a hexagon bolt head 13, viz. a fixed jaw 12 integral with the handle 1 and a movable jaw 10.

The handle 1 is provided with an insert of tool steel or like material, more precisely in a recess in the handle side, and the insert may be locked against the bottom of the handle 1, for example by means of a screw. The insert 2 preferably is a rectangular plate and may be of U shape conditioned by angularly placed walls 4, 5 constituting guide means for an arm in the form of a rocker 6.

FIG. 1 illustrates how an at least partially toothed gear 7, preferably made of tool steel, is rotatably mounted about an upstanding pin which may be fixedly applied to the bottom of the insert or within the handle 1 and extend through the bottom of said insert 2. The teeth of the gear 7 engage a rack 9 formed on a portion of the movable jaw 10. The jaw 10 and its associated rack thus may be moved back and forth by rotating or turning the gear 7 to the left or to the right.

Associated with the gear 7 is a spring 11 constantly striving to rotate the gear in a direction such that the jaws 10, 11 are moved towards one another. In the embodiment illustrated, this spring is a helical spring which encompasses the pin 8. However, it is also conceivable to use a tension spring which runs in a groove milled in the gear, in which case the tension spring continues in a curve-shaped configuration towards the rear of the handle and is fixed to the handle.

Figure 2:
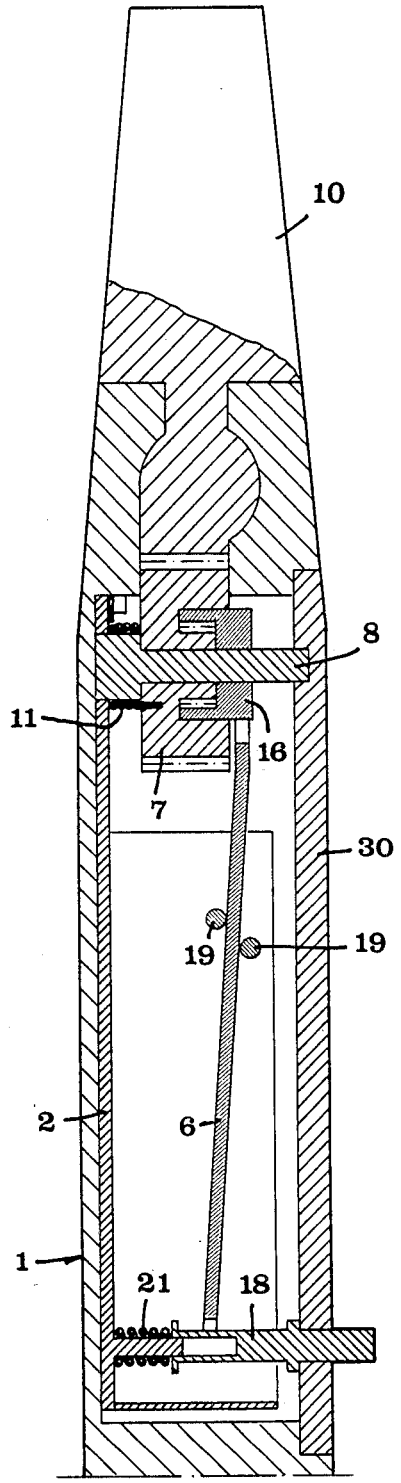
FIG. 2 is a section viewed from the left in FIG. 1, the wrench being shown in a first operating condition.

In FIG. 2, the mechanism illustrated is under a cover 30 providing for further guidance of the pin 8 which thus projects into or extends through a hole in the cover 30 or may be otherwise guided thereby.

Figure 4:
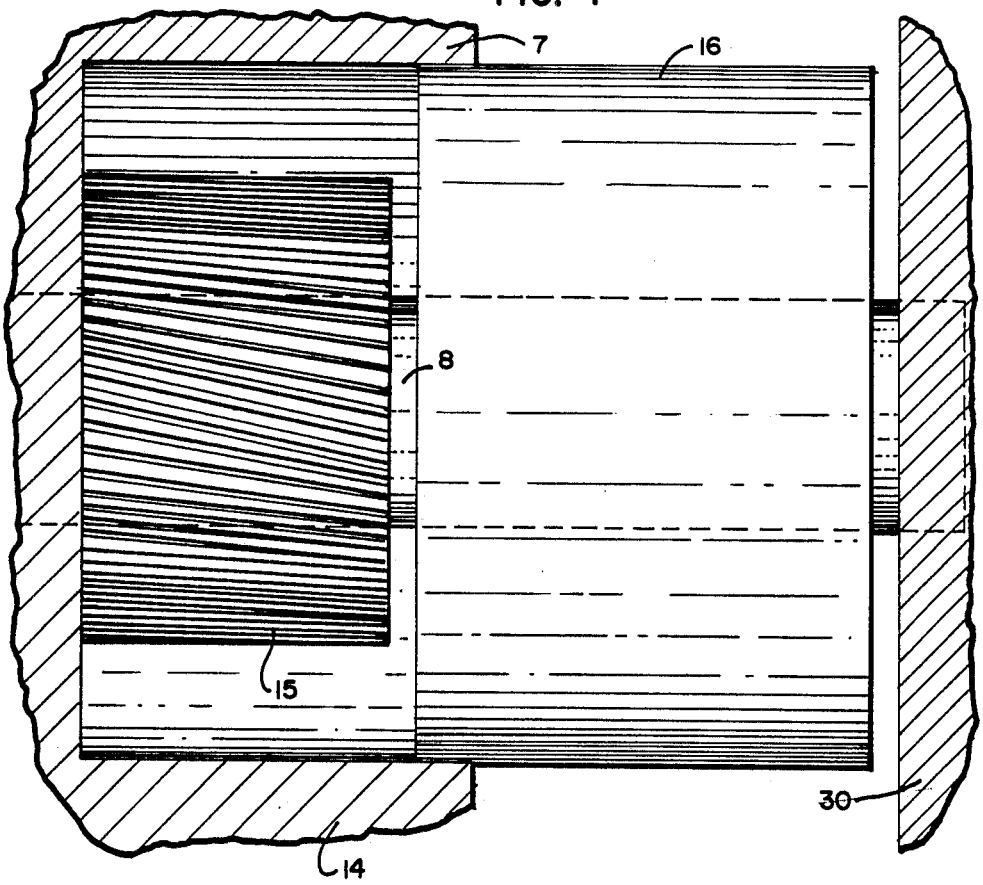
FIG. 4 is a view taken along lines 4—4 of FIG. 3.

To make the gear lock the movable jaw 10, the gear is formed with a portion 14 which has a longitudinal groove 15 and which constitutes one half of a splined coupling serving as a locking device. The other half of the splined coupling is formed by a sleeve 16 which is provided on its inner side with longitudinal grooves or teeth 17 adapted to engage the grooves or teeth 15. The sleeve 16 is hingedly connected with the rocker 6, but such that the sleeve cannot be rotated about its own axis. If desired, however, the articulation may be such that some small movement may be tolerated for the sleeve 16 so that it can smoothly move into engagement with the coupling half 14. In the embodiment illustrated, the ridges and valleys of the splined coupling are axial. However, the splined coupling may also be designed such that the said ridges and valleys are slightly inclined so that a certain pitch is obtained and so that also the gear 7 is actuated and rotated about its geometrical axis during engagement and disengagement of the splined coupling. A drawing of the inclined ridges and valleys is shown in FIG. 4. Thanks to the pitch, the effective size of the wrench can be made infinitely variable so that it will fit all nut and bolt dimensions.

Figure 3:
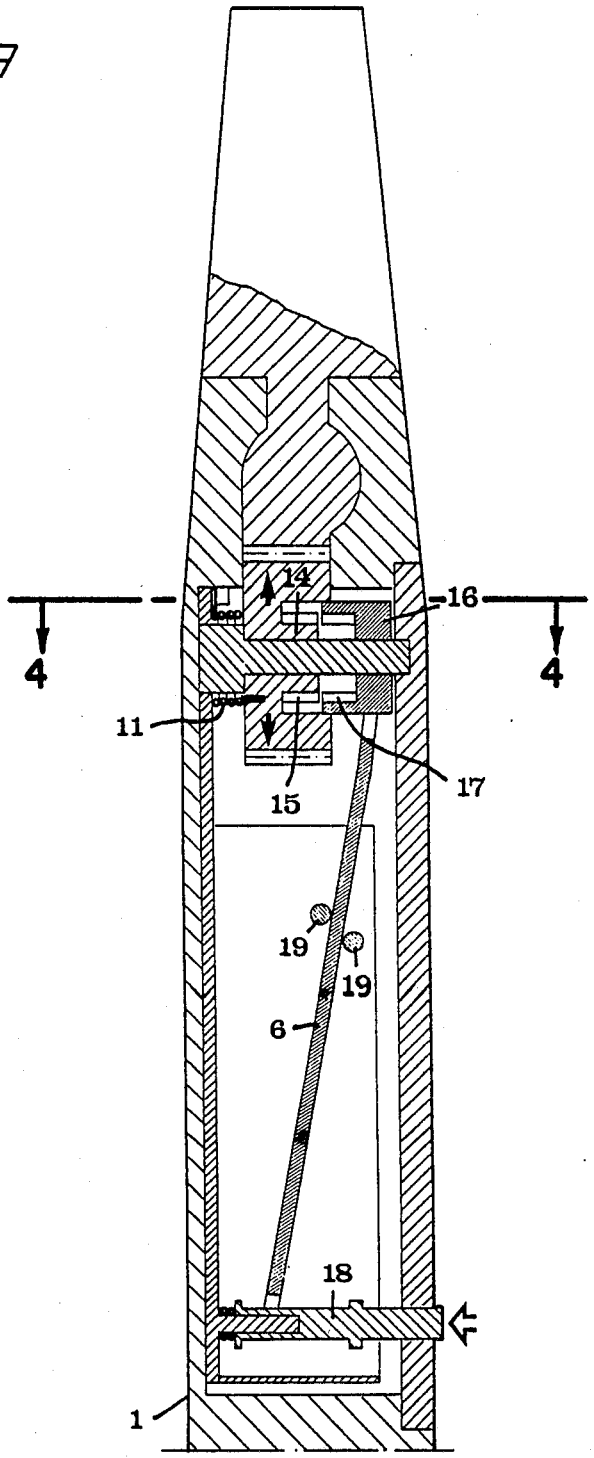
FIG. 3 is a similar section showing the wrench in a second operating condition.

The rocker 6 is guided by two guide rollers and is hingedly connected at its end opposite to the sleeve 16 with a push member 18 which can be manually pressed inwardly into the handle against the action of a compression spring 21. As will appear from FIG. 2, the spring 21 maintains the sleeve 16 in a position in which it locks the gear 7. However, as soon as the push member 18 is moved into the position shown in FIG. 3, the sleeve 16 is moved, via the rocker 6, out of engagement with the gear which thus is free to rotate, although against the action of the main spring 11. In this last-mentioned condition, the gripping mouth can be engaged with, for example, the bolt head 13, whereby the movable jaw 10 is automatically moved aside, although against the action of the spring 11, whereupon the movable jaw is engaged with the bolt head through the action of the said spring.

As will appear from FIG. 1, a graduated scale 31 is provided on the wrench to enable reading of the distance between the two jaws 10 and 12.

The wrench according to the invention may be used also as a conventional spanner, in which case it is possible to release or lock a jaw 10 merely by actuating the push member of the rocker and constantly to start a new stroke rotating the bolt head or nut to the left or to the right without necessitating removal of the spanner for a new stroke.

When the wrench according to the present invention is to be used over a longer period of time as a fixed wrench adjusted to a specific dimension, the rocker 6 may be made lockable and/or adjustable, for example, at its push member 18. This can be done by means of a set screw setting the push member in a fixed position.

The embodiment described above and illustrated in the drawings is, of course, also generally applicable to other fields of use, and furthermore the invention is not restricted to the embodiment described above and illustrated in the drawings, but may be varied within the scope of the appended claims.

What I claim and desire to secury by Letters Patent is:

1. A wrench comprising a handle and a gripping mouth defined by two jaws, one of which is fixed and the other movable to permit variation of the effective wrench size, said movable jaw being associated with a rack engaging a gear which is rotatably mounted relative to the handle and actuated by at least one spring constantly striving to rotate said gear in a direction such that the jaws will be moved towards one another, said gear cooperating with a locking device settable in two different positions, a first or opening position in which the gear is free to rotate, and a second or locking position in which the gear is non-rotatable and in which movement of the movable jaw relative to the fixed jaw is rendered impossible, wherein said locking device is in the form of a splined coupling comprising a coupling half or portion which comprises grooves on an internal annular surface of the gear, and a grooved sleeve movable back and forth into and out of engagement with the coupling half on the gear by means of a rocker said coupling half and the grooved sleeve being coaxially aligned and a manually operable push member associated with said rocker, a spring being adapted, when said push member is inoperative, to hold said rocker in a position such that the sleeve of said splined coupling engages and locks the coupling half on the gear, said sleeve being movable out of engagement with the coupling half of the gear by actuation of said pusher member via said rocker.

2. A wrench according to claim 1 wherein said splined coupling includes splines comprising plurality of mating ridges and valleys on the coupling half and the grooved sleeve and wherein said splines are slightly inclined from the coaxial axis of the coupling half and the grooved sleeve.

* * * * *